US008130117B2

(12) United States Patent
Hall et al.

(10) Patent No.: US 8,130,117 B2
(45) Date of Patent: Mar. 6, 2012

(54) DRILL BIT WITH AN ELECTRICALLY ISOLATED TRANSMITTER

(75) Inventors: David R. Hall, Provo, UT (US); Paula Turner, Pleasant Grove, UT (US); Christopher Durrand, Pleasant Grove, UT (US)

(73) Assignee: Schlumberger Technology Corporation, Houston, TX (US)

( * ) Notice: Subject to any disclaimer, the term of this patent is extended or adjusted under 35 U.S.C. 154(b) by 1158 days.

(21) Appl. No.: 11/759,992

(22) Filed: Jun. 8, 2007

(65) Prior Publication Data

US 2007/0229304 A1 Oct. 4, 2007

Related U.S. Application Data

(63) Continuation-in-part of application No. 11/750,700, filed on May 18, 2007, now Pat. No. 7,549,489, which is a continuation-in-part of application No.

(Continued)

(51) Int. Cl.
*G01V 3/00* (2006.01)
*E21B 47/01* (2006.01)

(52) U.S. Cl. ..... 340/853.1; 175/50; 73/152.03; 324/356

(58) Field of Classification Search ..... 175/40, 175/50; 73/152.03, 152.43; 376/911; 340/853.1; 324/352, 347, 354–358, 369; 702/9
See application file for complete search history.

(56) References Cited

U.S. PATENT DOCUMENTS 465,103 A 12/1891 Wegner (Continued)

OTHER PUBLICATIONS

Bonner, Steve, et al., "Measurements at the Bit: A New Generation of MWD Tools," *Oilfield Review*, pp. 44-54 (Apr./Jul. 1993).

(Continued)

*Primary Examiner* — Kenneth L Thompson
(74) *Attorney, Agent, or Firm* — Brinks Hofer Gilson & Lione

(57) ABSTRACT

In one aspect of the invention a downhole drill bit with a body intermediate a shank and a working surface. Extending from the work surface is a wear resistant electric transmitter electrically isolated from the drill bit body. A wear resistant electrically conductive receiver, also electrically isolated from the bit body, may be connected to a tool string component. The working surface may also have at least two wear resistant electrodes located intermediate the transmitter and receiver that are adapted to measure an electric potential in the formation.

22 Claims, 10 Drawing Sheets

Related U.S. Application Data

(63) 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, application No. 11/759,992, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(56) References Cited

U.S. PATENT DOCUMENTS

| | | | | | |
|---|---|---|---|---|---|
| 616,118 | A | | 12/1898 | Kuhne | |
| 946,060 | A | | 1/1910 | Looker | |
| 1,116,154 | A | | 11/1914 | Stowers | |
| 1,183,630 | A | | 5/1916 | Bryson | |
| 1,189,560 | A | | 7/1916 | Gondos | |
| 1,360,908 | A | | 11/1920 | Everson | |
| 1,387,733 | A | | 8/1921 | Midgett | |
| 1,460,671 | A | | 7/1923 | Hebsacker | |
| 1,544,757 | A | | 7/1925 | Hufford | |
| 1,821,474 | A | | 9/1931 | Mercer | |
| 1,879,177 | A | | 9/1932 | Gault | |
| 2,054,255 | A | | 9/1936 | Howard | |
| 2,064,255 | A | | 12/1936 | Garfield | |
| 2,169,223 | A | | 8/1939 | Christian | |
| 2,218,130 | A | | 10/1940 | Court | |
| 2,249,769 | A | * | 7/1941 | Leonardon | 324/351 |
| 2,320,136 | A | | 5/1943 | Kammerer | |
| 2,466,991 | A | | 4/1949 | Kammerer | |
| 2,540,464 | A | | 2/1951 | Stokes | |
| 2,545,036 | A | | 3/1951 | Kammerer | |
| 2,755,071 | A | | 7/1956 | Kammerer | |
| 2,776,819 | A | | 1/1957 | Brown | |
| 2,819,043 | A | | 1/1958 | Henderson | |
| 2,838,284 | A | | 6/1958 | Austin | |
| 2,894,722 | A | | 7/1959 | Buttolph | |
| 2,901,223 | A | | 8/1959 | Scott | |
| 2,917,704 | A | * | 12/1959 | Arps | 324/352 |
| 2,963,102 | A | | 12/1960 | Smith | |
| 3,135,341 | A | | 6/1964 | Ritter | |
| 3,294,186 | A | | 12/1966 | Buell | |
| 3,301,339 | A | | 1/1967 | Pennebaker, Jr. | |
| 3,379,264 | A | | 4/1968 | Cox | |
| 3,429,390 | A | | 2/1969 | Bennett | |
| 3,493,165 | A | | 2/1970 | Schonfeld | |
| 3,583,504 | A | | 6/1971 | Aalund | |
| 3,765,493 | A | | 10/1973 | Rosar et al. | |
| 3,821,993 | A | | 7/1974 | Kniff | |
| 3,885,638 | A | | 5/1975 | Skidmore | |
| 3,960,223 | A | | 6/1976 | Kleine | |
| 4,081,042 | A | | 3/1978 | Johnson | |
| 4,096,917 | A | | 6/1978 | Harris | |
| 4,106,577 | A | | 8/1978 | Summers | |
| 4,176,723 | A | | 12/1979 | Arceneaux | |
| 4,253,533 | A | | 3/1981 | Baker | |
| 4,262,758 | A | | 4/1981 | Evans | |
| 4,280,573 | A | | 7/1981 | Sudnishnikov | |
| 4,304,312 | A | | 12/1981 | Larsson | |
| 4,397,361 | A | | 8/1983 | Langford | |
| 4,445,580 | A | | 5/1984 | Sahley | |
| 4,448,269 | A | | 5/1984 | Ishikawa | |
| 4,499,795 | A | | 2/1985 | Radtke | |
| 4,531,592 | A | | 7/1985 | Hayatdavoudi | |
| 4,535,853 | A | | 8/1985 | Ippolito | |
| 4,538,691 | A | | 9/1985 | Dennis | |
| 4,566,545 | A | | 1/1986 | Story | |
| 4,574,895 | A | | 3/1986 | Dolezal | |
| 4,640,374 | A | | 2/1987 | Dennis | |
| 4,852,672 | A | | 8/1989 | Behrens | |
| 4,889,017 | A | | 12/1989 | Fuller | |
| 4,962,822 | A | | 10/1990 | Pascale | |
| 4,981,184 | A | | 1/1991 | Knowlton | |
| 5,009,273 | A | | 4/1991 | Grabinski | |
| 5,027,914 | A | | 7/1991 | Wilson | |
| 5,038,873 | A | | 8/1991 | Jurgens | |
| 5,119,892 | A | | 6/1992 | Clegg | |
| 5,141,063 | A | | 8/1992 | Quesenbury | |
| 5,186,268 | A | | 2/1993 | Clegg | |
| 5,222,566 | A | | 6/1993 | Taylor | |
| 5,255,749 | A | | 10/1993 | Bumpurs | |
| 5,265,682 | A | | 11/1993 | Russell | |
| 5,339,037 | A | | 8/1994 | Bonner et al. | |
| 5,361,859 | A | | 11/1994 | Tibbitts | |
| 5,410,303 | A | | 4/1995 | Comeau | |
| 5,417,292 | A | | 5/1995 | Polakoff | |
| 5,423,389 | A | | 6/1995 | Warren | |
| 5,442,294 | A | | 8/1995 | Rorden | |
| 5,507,357 | A | | 4/1996 | Hult | |
| 5,560,440 | A | | 10/1996 | Tibbitts | |
| 5,568,838 | A | | 10/1996 | Struthers | |
| 5,655,614 | A | | 8/1997 | Azar | |
| 5,678,644 | A | | 10/1997 | Fielder | |
| 5,720,355 | A | | 2/1998 | Lamine et al. | |
| 5,732,784 | A | | 3/1998 | Nelson | |
| 5,794,728 | A | | 8/1998 | Palmberg | |
| 5,896,938 | A | | 4/1999 | Moeny | |
| 5,947,215 | A | | 9/1999 | Lundell | |
| 5,950,743 | A | | 9/1999 | Cox | |
| 5,957,223 | A | | 9/1999 | Doster | |
| 5,979,571 | A | | 11/1999 | Scott et al. | |
| 5,992,547 | A | | 11/1999 | Caraway | |
| 5,992,548 | A | | 11/1999 | Silva | |
| 6,021,859 | A | | 2/2000 | Tibbitts | |
| 6,039,131 | A | | 3/2000 | Beaton | |
| 6,057,784 | A | | 5/2000 | Schaaf et al. | |
| 6,131,675 | A | | 10/2000 | Anderson | |
| 6,150,822 | A | | 11/2000 | Hong et al. | |
| 6,186,251 | B1 | | 2/2001 | Butcher | |
| 6,202,761 | B1 | | 3/2001 | Forney | |
| 6,213,226 | B1 | | 4/2001 | Eppink | |
| 6,223,824 | B1 | | 5/2001 | Moyes | |
| 6,269,893 | B1 | | 8/2001 | Beaton | |
| 6,296,069 | B1 | | 10/2001 | Lamine | |
| 6,298,930 | B1 | | 10/2001 | Sinor | |
| 6,332,503 | B1 | | 12/2001 | Pessier | |
| 6,340,064 | B2 | | 1/2002 | Fielder | |
| 6,364,034 | B1 | | 4/2002 | Schoeffler | |
| 6,394,200 | B1 | | 5/2002 | Watson | |
| 6,439,326 | B1 | | 8/2002 | Huang et al. | |
| 6,474,425 | B1 | | 11/2002 | Truax | |
| 6,484,825 | B2 | | 11/2002 | Watson | |
| 6,510,906 | B1 | | 1/2003 | Richert | |
| 6,513,606 | B1 | | 2/2003 | Krueger | |
| 6,533,050 | B2 | | 3/2003 | Molloy | |
| 6,594,881 | B2 | | 7/2003 | Tibbitts | |
| 6,601,454 | B1 | | 8/2003 | Botnan | |
| 6,622,803 | B2 | | 9/2003 | Harvey | |
| 6,668,949 | B1 | | 12/2003 | Rives | |
| 6,729,420 | B2 | | 5/2004 | Mensa-Wilmot et al. | |
| 6,732,817 | B2 | | 5/2004 | Dewey | |

| | | | | |
|---|---|---|---|---|
| 6,822,579 | B2 | 11/2004 | Goswami | |
| 6,850,068 | B2 | 2/2005 | Chemali et al. | |
| 6,929,076 | B2 | 8/2005 | Fanuel et al. | |
| 6,953,096 | B2 | 10/2005 | Gledhill | |
| 7,095,233 | B1 * | 8/2006 | Tabanou et al. | 324/369 |
| 2003/0213621 | A1 | 11/2003 | Britten | |
| 2004/0238221 | A1 | 12/2004 | Runia et al. | |
| 2004/0256155 | A1 | 12/2004 | Kriesels et al. | |

OTHER PUBLICATIONS

Ocean Drilling Program (ODP) Logging Services, "Logging-While-Drilling Resistivity-at-Bit Tool," Lamont-Doherty Earth Observatory, Palisades, NY, 2 pages (Dec. 2003).

* cited by examiner

DRILL BIT WITH AN ELECTRICALLY ISOLATED TRANSMITTER

CROSS REFERENCE TO RELATED APPLICATIONS

This patent application is a continuation-in-part of U.S. patent application Ser. No. 11/750,700 filed on May 18, 2007 and entitled Jack Element with a Stop-off, which is now U.S. Pat. No. 7,549,489 issued on Jun. 23, 2009. U.S. patent application Ser. No. 11/750,700 a continuation-in-part of U.S. patent application Ser. No. 11/737,034 filed on Apr. 18, 2007 and entitled Rotary Valve for Steering a Drill String, which is now U.S. Pat. No. 7,503,405 issued on Mar. 17, 2009. U.S. patent application Ser. No. 11/737,034 is a continuation-in-part of U.S. patent application Ser. No. 11/686,638 filed on Mar. 15, 2007 and entitled Rotary Valve for a Jack Hammer, which is now U.S. Pat. No. 7,424,922 issued on Sep. 16, 2008. U.S. patent application Ser. No. 11/686,638 is a continuation-in-part of U.S. patent application Ser. No. 11/680,997 filed on Mar. 1, 2007 and entitled Bi-center Drill Bit, which is now U.S. Pat. No. 7,419,016 issued on Sep. 2, 2008. U.S. patent application Ser. No. 11/680,997 is a continuation-in-part of U.S. patent application Ser. No. 11/673,872 filed on Feb. 12, 2007 and entitled Jack Element in Communication with an Electric Motor and/or generator, which is now U.S. Pat. No. 7,484,576 issued on Feb. 3, 2009. U.S. patent application Ser. No. 11/673,872 is a continuation-in-part of U.S. patent application Ser. No. 11/611,310 filed on Dec. 15, 2006 and entitled System for Steering a Drill String, which is now now U.S. Pat. No. 7,600,586 issued on Oct. 13, 2009. This patent application is also a continuation in-part of U.S. patent application Ser. No. 11/278,935 filed on Apr. 6, 2006 and entitled Drill Bit Assembly with a Probe, which is now U.S. Pat. No. 7,426,968 issued on Sep. 23, 2008. U.S. patent application Ser. No. 11/278,935 is a continuation-in-part of U.S. patent application Ser. No. 11/277,394 filed on Mar. 24, 2006 and entitled Drill Bit Assembly with a Logging Device, which is now U.S. Pat. No. 7,398,837 issued on Jul. 15, 2008. U.S. patent application Ser. No. 11/277,394 is a continuation-in-part of U.S. patent application Ser. No. 11/277,380 also filed on Mar. 24, 2006 and entitled A Drill Bit Assembly Adapted to Provide Power Downhole, which is now U.S. Pat. No. 7,337,858 issued on Mar. 4, 2008. U.S. patent application Ser. No. 11/277,380 is a continuation-in-part of U.S. patent application Ser. No. 11/306,976 filed on Jan. 18, 2006 and entitled Drill Bit Assembly for Directional Drilling. which is now U.S. Pat. No. 7,360,610 issued on Apr. 22, 2008. U.S. patent application Ser. No. 11/306,976 is a continuation-in-part of U.S. patent application Ser. No. 11/306,307 filed on Dec. 22, 2005, entitled Drill Bit Assembly with an Indenting Member, which is now U.S. Pat. No. 7,225,886 issued on Jun. 5, 2007. U.S. patent application Ser. No. 11/306,307 is a continuation-in-part of U.S. patent application Ser. No. 11/306,022 filed on Dec. 14, 2005, and entitled Hydraulic Drill Bit Assembly, which is now U.S. Pat. No. 7,198,119 issued on Apr. 3, 2007. U.S. patent application Ser. No. 11/306,022 is a continuation-in-part of U.S. patent application Ser. No. 11/164,391 filed on Nov. 21, 2005, entitled Drill Bit Assembly, which is now U.S. Pat. No. 7,270,196 issued on Sep. 18, 2007. All of these applications are herein incorporated by reference in their entirety.

BACKGROUND OF THE INVENTION

The present invention relates to the field of downhole oil, gas, and/or geothermal exploration and more particularly to the field of drill bits for aiding such exploration and drilling.

Drill bits use rotary energy provided by the tool string to cut through downhole formations, thus advancing the tool string further into the ground. To use drilling time effectively, sensors have been placed in the drill string, usually in the tool string, to assist the operator in making drilling decisions. In the patent prior art, sensors have been disclosed in drill bits.

For example, U.S. Pat. No. 6,150,822 to Hong, et al discloses a microwave frequency range sensor (antenna or wave guide) disposed in the face of a diamond or PDC drill bit configured to minimize invasion of drilling fluid into the formation ahead of the bit. The sensor is connected to an instrument disposed in a sub interposed in the drill stem for generating and measuring the alteration of microwave energy.

U.S. Pat. No. 6,814,162 to Moran, et al discloses a drill bit, comprising a bit body, a sensor disposed in the bit body, a single journal removably mounted to the bit body, and a roller cone rotatably mounted to the single journal. The drill bit may also comprise a short-hop telemetry transmission device adapted to transmit data from the sensor to a measurement-while-drilling device located above the drill bit on the drill string.

U.S. Pat. No. 6,913,095 to Krueger discloses a closed-loop drilling system utilizes a bottom hole assembly ("BHA") having a steering assembly having a rotating member and a non-rotating sleeve disposed thereon. The sleeve has a plurality of expandable force application members that engage a borehole wall. A power source and associated electronics for energizing the force application members are located outside of the non-rotating sleeve.

BRIEF SUMMARY OF THE INVENTION

In one aspect of the invention a downhole drill bit with a body intermediate a shank and a working surface. Extending from the work surface is a wear resistant electric transmitter electrically isolated from the drill bit body. A wear resistant electrically conductive receiver, also electrically isolated from the bit body, may be connected to a tool string component. The working surface may also have at least two wear resistant electrodes located intermediate the transmitter and receiver that are adapted to measure an electric potential in the formation.

The drill bit may also be in communication with a downhole telemetry system incorporated in a drill string to which the drill bit is attached. At least a portion of each electrode may be electrically isolated from the body portion and comprise an electrically conductive polycrystalline diamond. The electrodes may be incorporated into penetration limiters or cutting elements so that they may be in constant contact with the formation.

At least one wear resistant electrode intermediate the transmitter and receiver may be a focusing electrode that may produce a bucking current. This focusing electrode may be incorporated into penetration limiters, cutting elements, or combinations thereof. Intermediate the transmitter and receiver may also be a monitor electrode incorporated into a penetration limiter, cutting element, or combinations thereof. The transmitter may have an asymmetric distal end for steering the drill bit. The transmitter may also be in electrical communication with a battery, a telemetry system, a power generator, or combinations thereof In order to electrically isolate the electrodes, the transmitter, and/or the receivers from each other and from the tool string they may be encased within a dielectric material, which may comprise a ceramic, a rubber, a plastic, a metal a gas or combinations thereof.

The tool string component may also be a stabilizer or a reamer that contacts the wall in order to protect the bit from uneven wear. The drill bit may be a shear bit or a percussion bit. The percussion bit may range in size and surface shape such as a conical surface, a flat surface, a rounded surface, a domed surface, or combinations thereof.

In some embodiments, the electrically isolated transmitter may be incorporated into a cutting element or a penetration limiter. In some embodiments, the transmitter, the receiver, or electrodes may be spring loaded to help ensure contact with the formation.

DETAILED DESCRIPTION OF THE INVENTION AND THE PREFERRED EMBODIMENT

Figure 1:
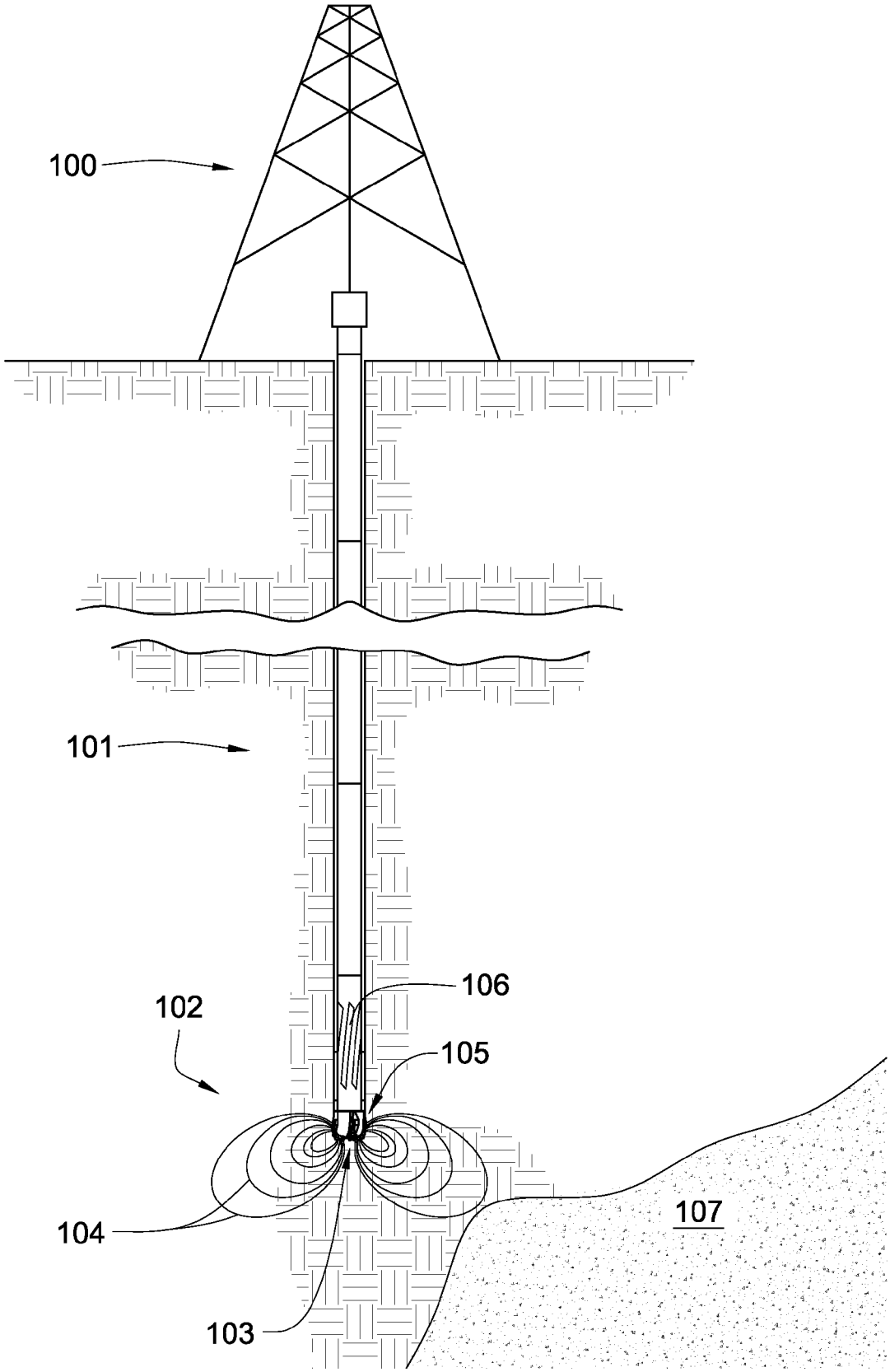
FIG. 1 is an orthogonal diagram of an embodiment of a derrick attached to a tool string comprising a drill bit.

FIG. 1 is an orthogonal diagram of a derrick 100 attached to a tool string 101 comprising a drill bit 102 located at the bottom of a bore hole that may acquire data about downhole conditions. The tool string may be made of rigid drill pipe, drill collars, heavy weight pipe, jars, and/or subs. In some embodiments coiled tubing or other types of tool strings may be used. As the drill bit 102 rotates downhole, the tool string 101 advances farther into the earth. The bottom of the tool string may be generally stabilized by a stabilizer 106 that may be placed near the drill bit 102 or else where along the tool string. Sensors may be positioned near or on the drill bit to locate oil, gas, or geothermal reservoirs 107 in the earth. As shown in FIG. 1 a laterolog current 104 is being emitted into the formation from a transmitter 103 substantially located at the center of the drill bit. Receivers 105 located on the gauge of the drill bit may be adapted to pick up the laterolog signal.

Figure 2:
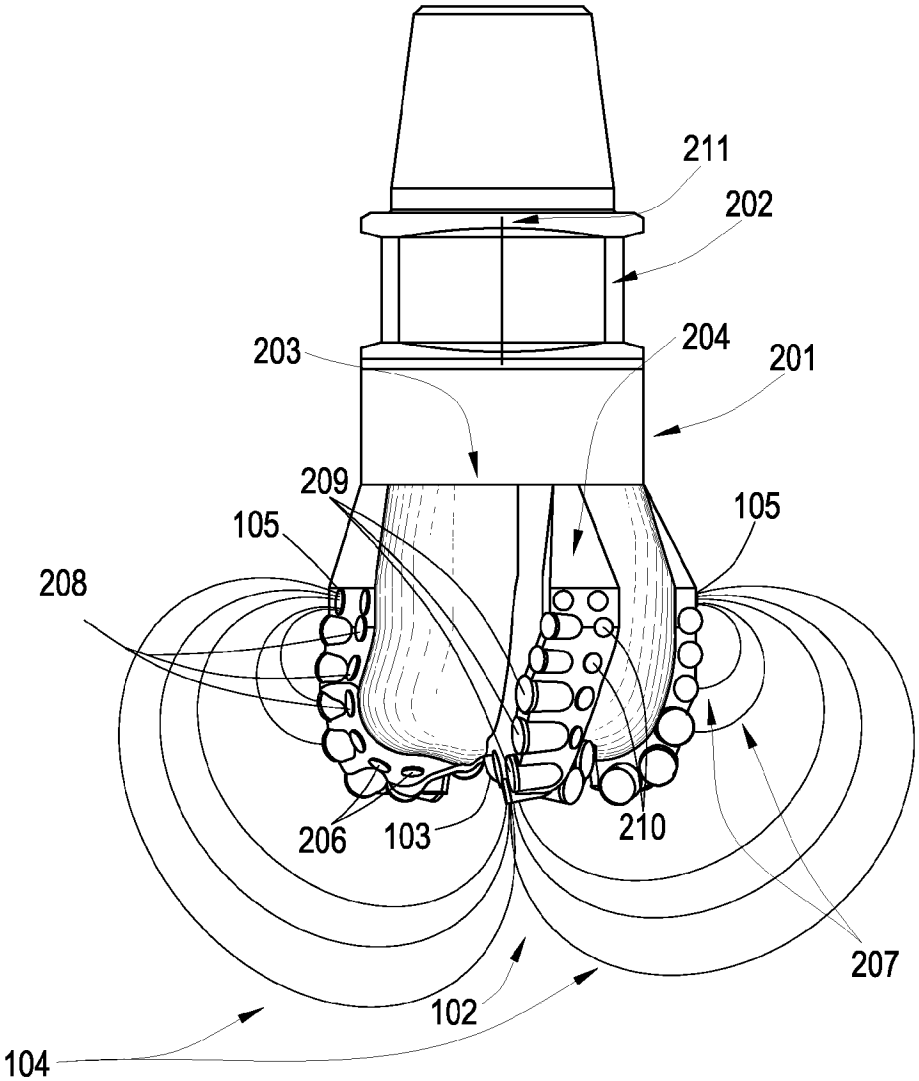
FIG. 2 is an orthogonal diagram of an embodiment of a drill bit.

FIG. 2 is an orthogonal diagram of a drill bit 102. In the preferred embodiment the drill bit 102 comprises a body 201 intermediate a shank 202 and a working surface 203. The shank 202 may comprise flats 211 for threading the drill bit onto the tool string 101. The drill bit 102 may comprise electrodes which may be incorporated into cutting elements 209 or penetration limiters 210 which may facilitate consistent contact with the bore hole. The cutting elements 209 and the penetration limiters 210 may comprise electrically conductive polycrystalline diamond to improve wear resistance. Degrading the formation may be facilitated by positioning the blades 204 in a helical or curved manner as shown in FIG. 2. The working surface 203 may comprise at least one blade 204. The Transmitter 103 electrically isolated from the body 201 may be extended axially from the working surface 203. A laterolog current 104 may be passed through the transmitter 103 and into the formation and may return to a least one receiver electrode 105. The voltage and laterolog current 104 may vary as they are passed through the transmitter 103. The working surface 203 may further comprise an electrically isolated set of monitor electrodes 206 that may measure voltage potential in the formation while the laterolog current 104 is being passed from the transmitter to the receiver 105. The monitor electrodes 206 may be located proximate the transmitter 103. A bucking current 207 may be adjusted continuously and sent through at least one electrically isolated focusing electrode 208 to force the laterolog current 104 into the formation. Both the laterolog current 104 and the bucking current 207 generally return to the receiver 105 electrode.

Figure 3:
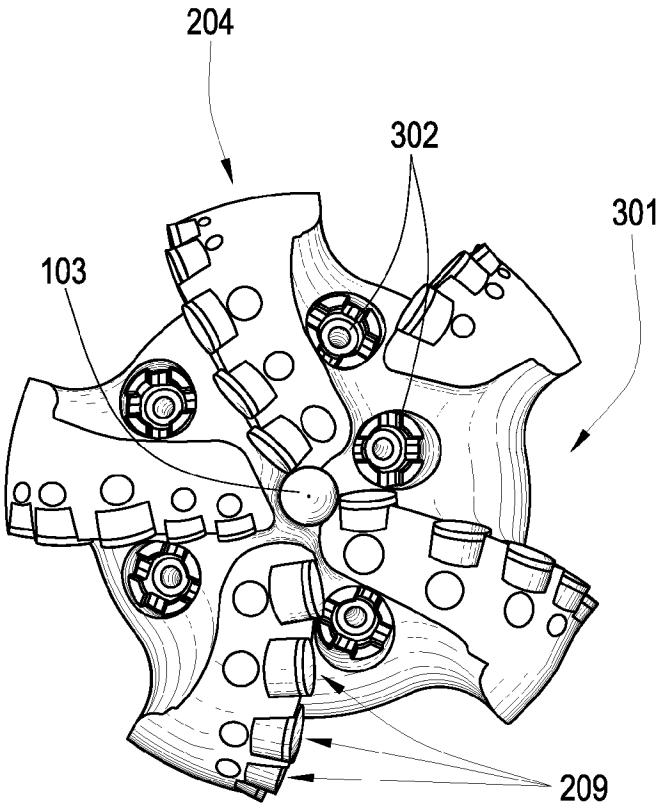
FIG. 3 is a bottom orthogonal diagram of an embodiment of a drill bit.

FIG. 3 is a bottom perspective diagram of an embodiment of a drill bit 102. Several blades 204 extend outwardly from the bit body 201, each of which comprises a plurality of cutting elements 209. A drill bit 102 most suitable for the present invention may have at least two blades 204; preferably the drill bit 102 will have between three and seven blades 204. The blades may collectively form an inverted conical region with junk slots 301 separating each blade.

The transmitter 103 may be substantially coaxial with an axis of rotation and extends within the conical region. A plurality of nozzles 302 are fitted into recesses formed in the working face. Each nozzle 302 may be oriented such that a jet of drilling mud ejected from the nozzles 302 engages the formation and/or cleans the junk slots. The nozzles may be positioned within the junk slots. In some embodiments, the nozzles may be part of the jack element.

Figure 4:
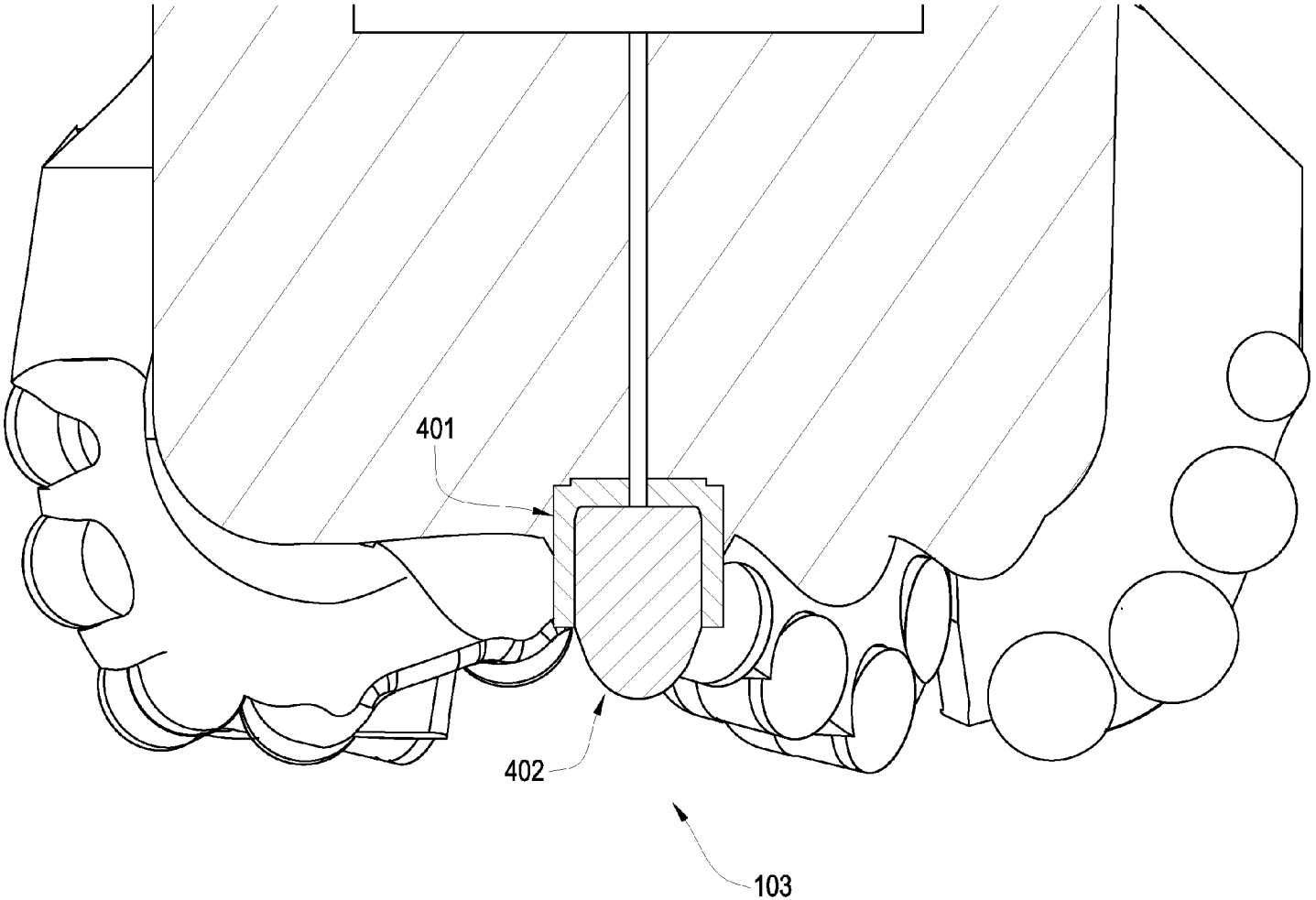
FIG. 4 is a cross-sectional diagram of an embodiment of an electrically isolated transmitter.
Figure 5:
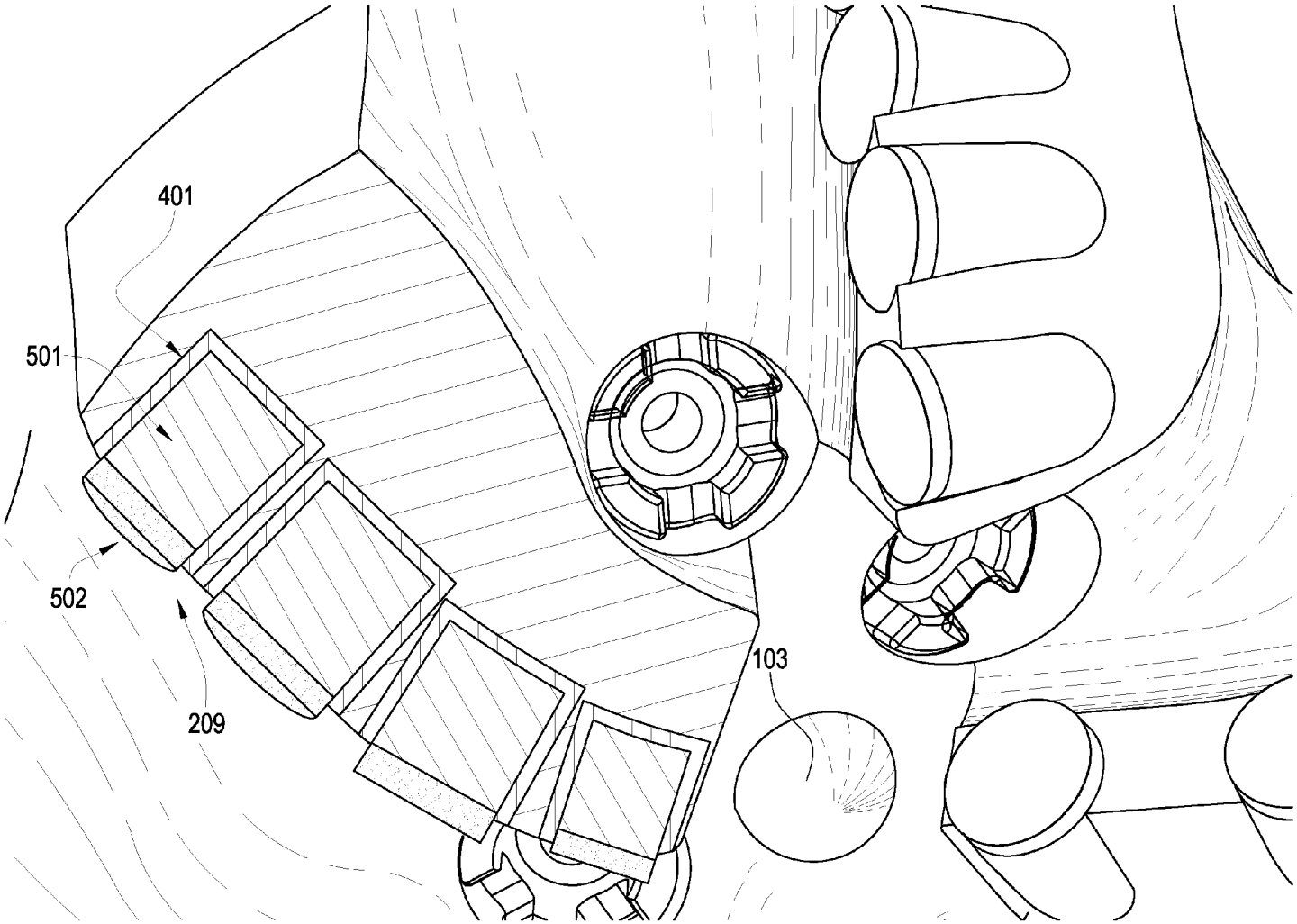
FIG. 5 is a cross-sectional diagram of an embodiment of an electrically isolated cutting element.

FIGS. 4 and 5 are cross-sectional diagrams of an electrically isolated transmitter 103 and cutting elements 209. The transmitter 103 may be a jack element incorporated into the drill bit 102. The transmitter 103 may comprise a generally hemispherical shape, a generally flat shape, a generally conical shape, a generally round shape, a generally asymmetric shape, a pointed shape, or combinations thereof. A portion of the transmitter 103 and cutting element 209 may be press-fit into a dielectric material 401 which may also be press-fit into the drill bit 102. This may allow for locating and quantifying the presence of materials such as hydrocarbons. Without the dielectric material 401 the current passing through the transmitter 103 and cutting element 209 may short to the bit body, thus preventing accurate measurements. The dielectric material 401 may comprise a ceramic, rubber, plastic, metal, a gas or combinations thereof The dielectric material may be in a cup shape with a passage that may allow for an insulated electrical conductor to pass through.

The transmitter 103 may be made of a cemented metal carbide. In some embodiments, to electrically isolate the transmitter 103, a thin portion of metal may be leached out of the surface of the transmitter 103 where it contacts the bit body. In other embodiments, a high temperature plastic, paint or other coating or material which is electrically insulating may be used to keep the transmitter from shorting to the bit body. Other types of material that may be used to electrically isolate the transmitter or the electrodes may be transformation toughened zirconia or zirconium toughened alumina. The transmitter 103 may also use a physical vapor deposited coating to become electrically isolated.

Figure 6:
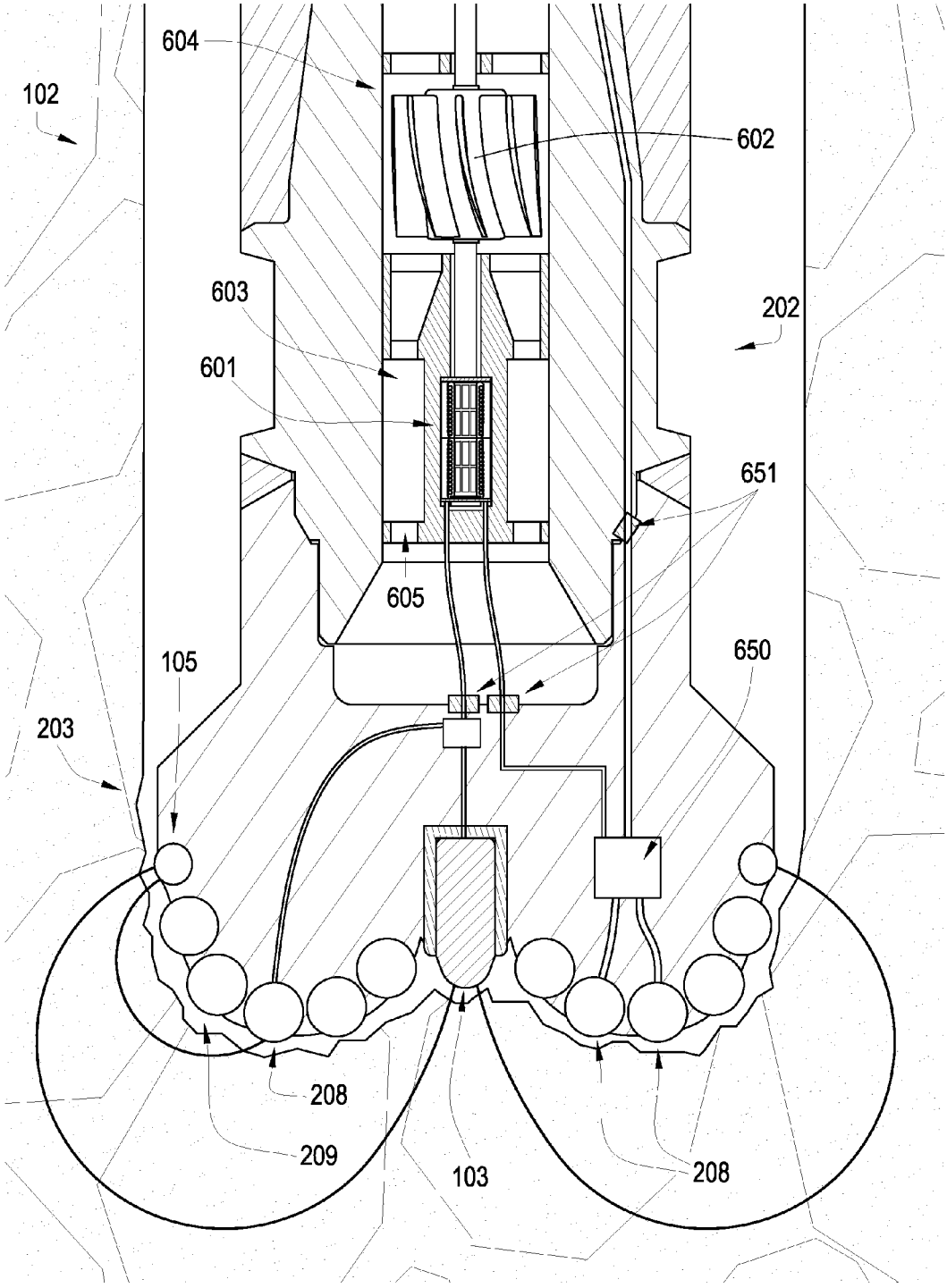
FIG. 6 is a cross-sectional diagram of an embodiment of a downhole tool string component.

FIG. 6 is cross-sectional diagram of an embodiment of a drill bit. The shank 202 may comprise an electric generator 601 which may produce an electrical current directly to the transmitter 103 and focusing electrodes 208. The electric generator 601 may also be used as a motor. In such cases the generator may be powered by a turbine 602 as in the embodiment of FIG. 6. The turbine 602 may be disposed within a recess 603 formed in the shank 202 comprising an entry passage 604 and an exit passage 605 to allow fluid to flow past the turbine 602, which may cause it to rotate. The turbine 602 and/or generator may also be disposed within the bore of the tool string 101, which may allow for more power to be generated, if needed. The shank 202 may be welded to the working surface 203. In this case couplers 651 are placed near the weld for connection of wires. The turbine 602 may be attached to a generator in electrical communication with the electric motor 601, providing the power necessary to produce a current. The current generally travels through the transmitter 103 and through an electrode incorporated into a cutting element 209. The current may then return to the receiver 105 that may be incorporated into another cutting element 209. The electric motor 601 and focusing electrodes 208 may be in communication with a local processing element 650. The processing element may log measurements which may then be routed to tool string control equipment or to surface equipment to be interpreted. Once interpreted, the drill bit 102 assembly may be directed according to information provided by the measurements.

Figure 7:
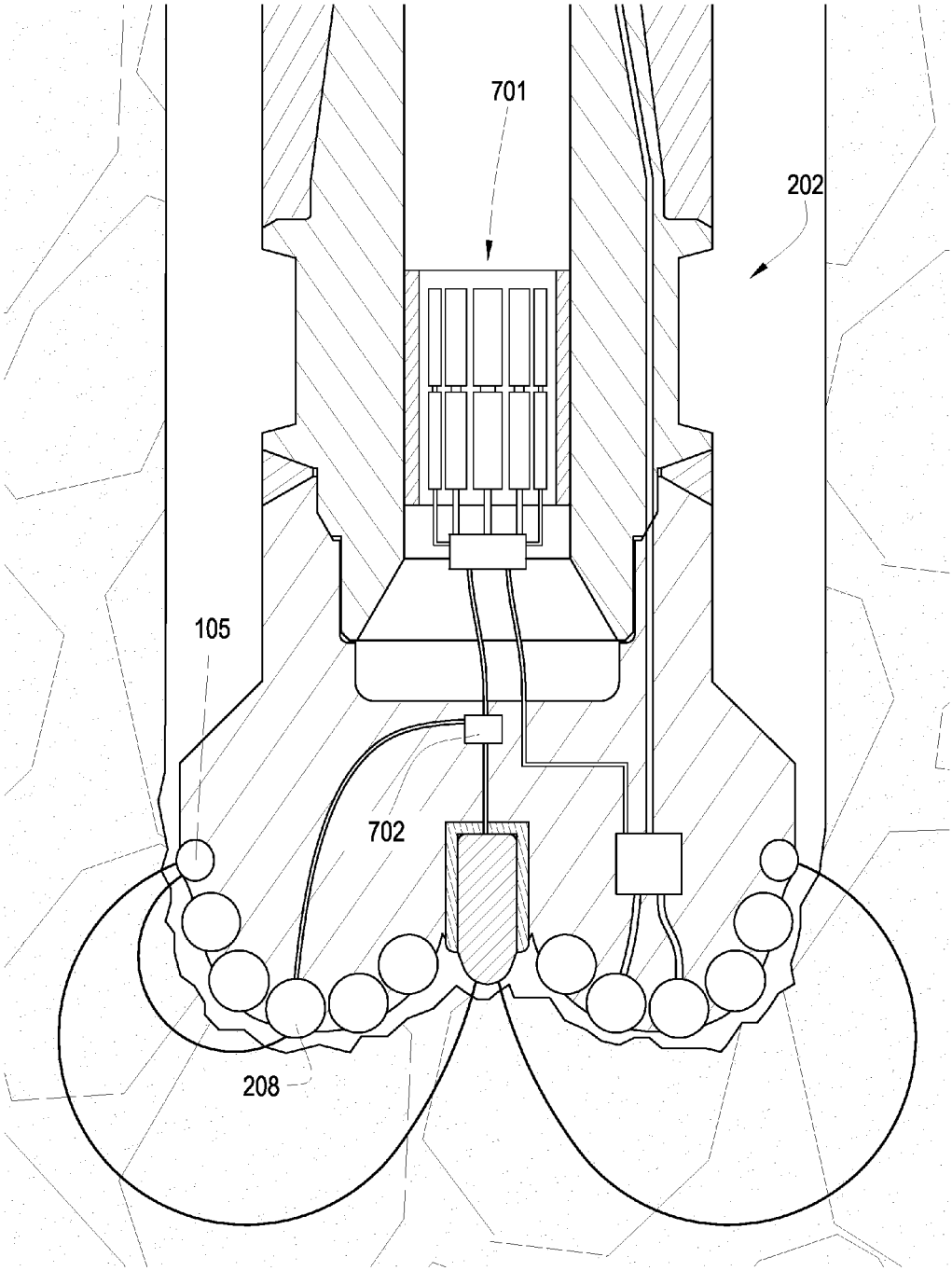
FIG. 7 is a cross-sectional diagram of another embodiment of a downhole tool string component.

FIG. 7 is a cross-sectional diagram of another embodiment of a downhole tool string component. A battery system 701 may be placed within a recess in the drill bit 102. The battery system 701 may comprise multiple batteries electrically linked as shown in FIG. 7 or one single battery sufficient to store a required amount of energy. The battery system 701 may produce a current that flows to the transmitter 103 and to the focusing electrodes 208. A current divider 702 may be placed within the drill bit 102 to direct the current to the proper location.

Figure 8:
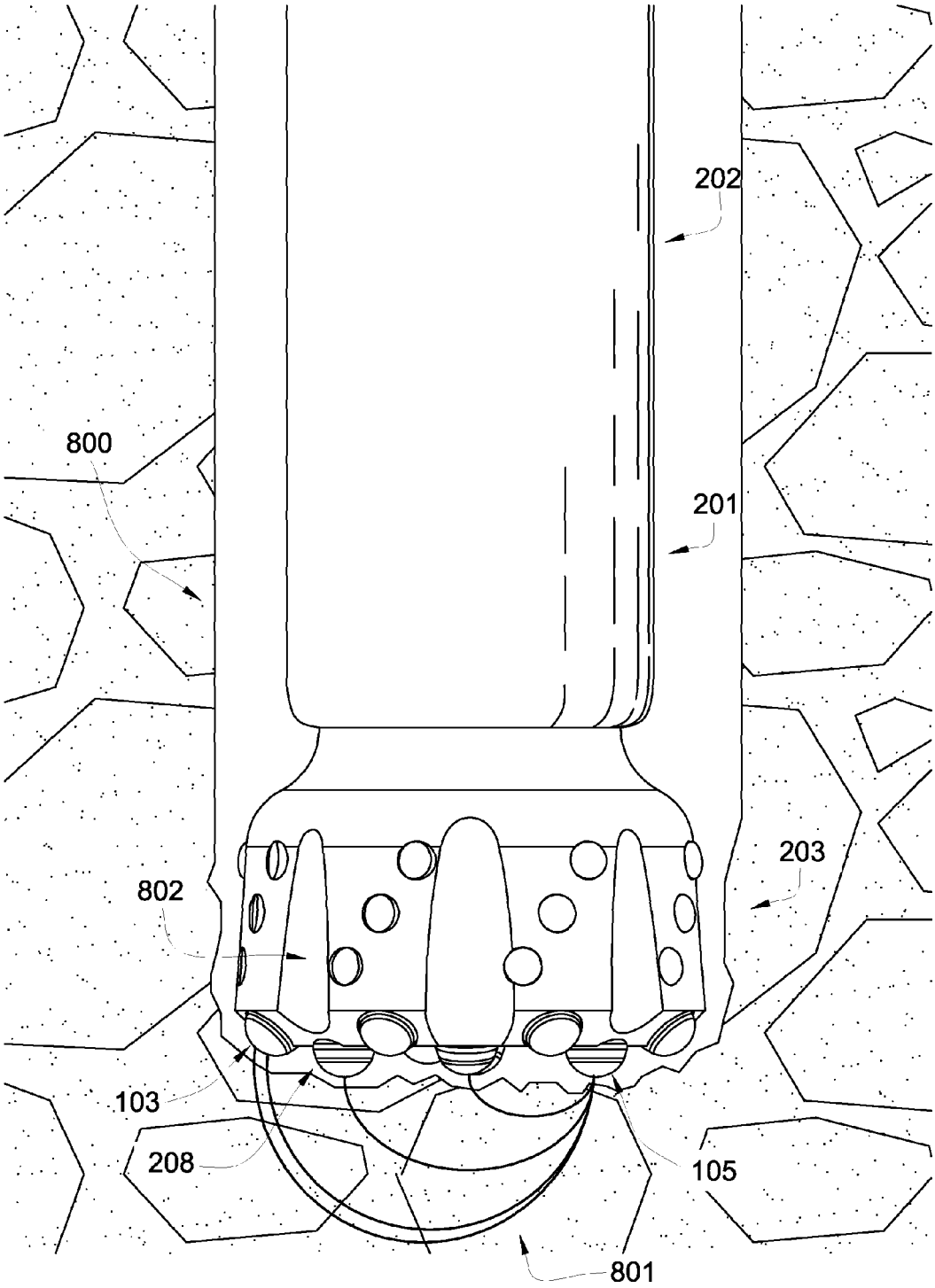
FIG. 8 is an orthogonal diagram of an embodiment of a percussion bit.

FIG. 8 is an orthogonal diagram of a percussion bit 800. The percussion bit 800 comprises a body portion 201 intermediate a shank 202 and a working surface 203. The working surface 203 comprises a face 801 that may comprise a flat surface, a conical surface, a flat surface, a rounded surface, a domed surface, or combinations thereof with multiple electrically isolated cutting elements 209. The transmitter 103 may be incorporated into the one of the cutting elements and may pass a current to a receiver 105 which may also be incorporate into one of the cutting elements. Other cutting elements may incorporate bucking electrodes and monitor electrodes.

Figure 9:
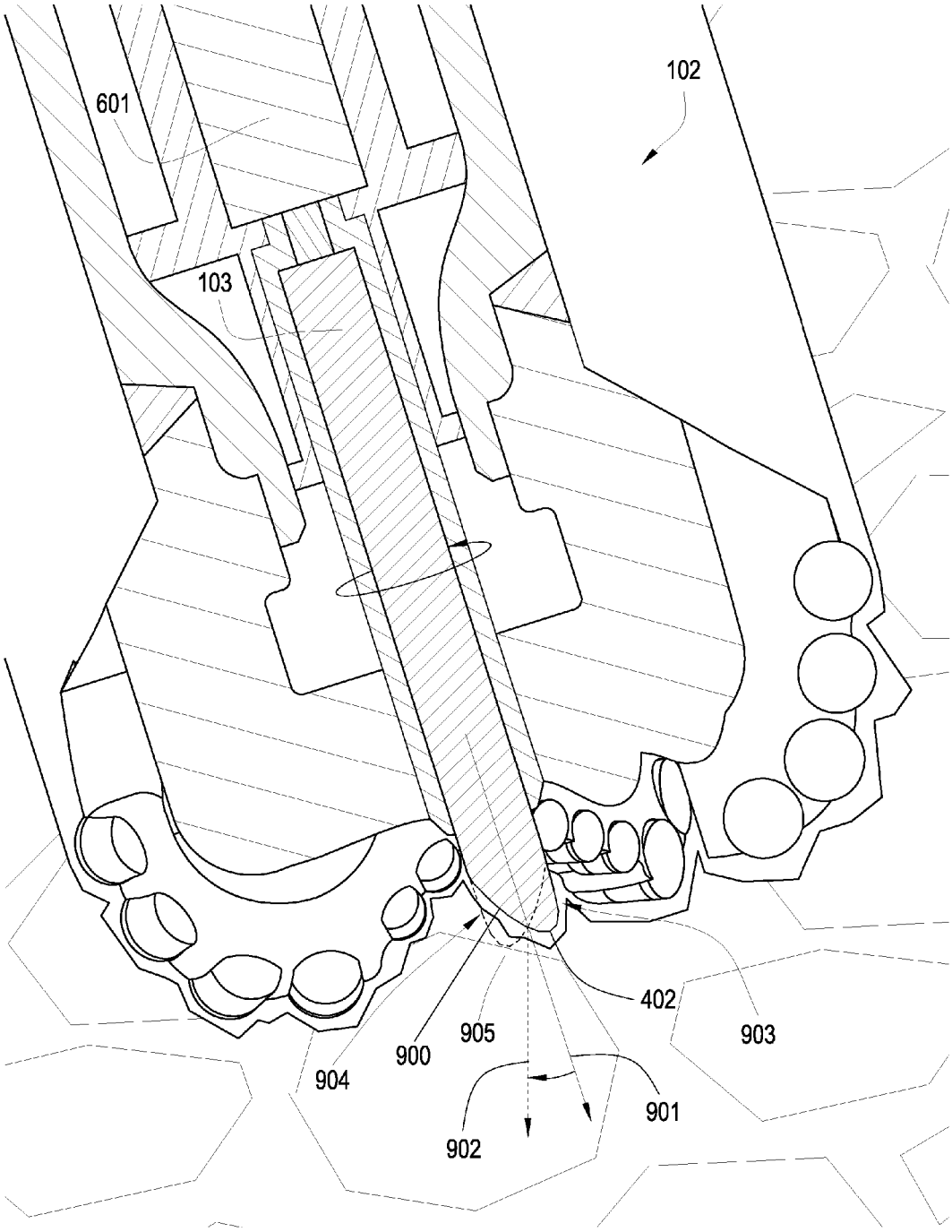
FIG. 9 is a cross-sectional diagram of another embodiment of a drill bit.

Now referring to FIG. 9, the drill bit 102 comprises a transmitter 103 that may comprise a biased distal end 402 which may be adapted to steer the tool string. The electric motor 601 may counter-rotate the shaft with respect to the drill bit 102 such that the shaft remains rotationally stationary with respect to the formation. While rotationally stationary, the bias may cause the drill bit 102 to steer in a desired direction. To change the direction from a first direction 901 to another direction 902, the motor may rotate the transmitter 103 from the first position 903 to the other position 904, as represented by the dashed outline 905, such that the bias 900 begins to direct the tool string 101 in the second direction 902. To maintain the tool string 101 in a constant direction, the motor may make the transmitter rotate with respect to the formation.

Figure 10:
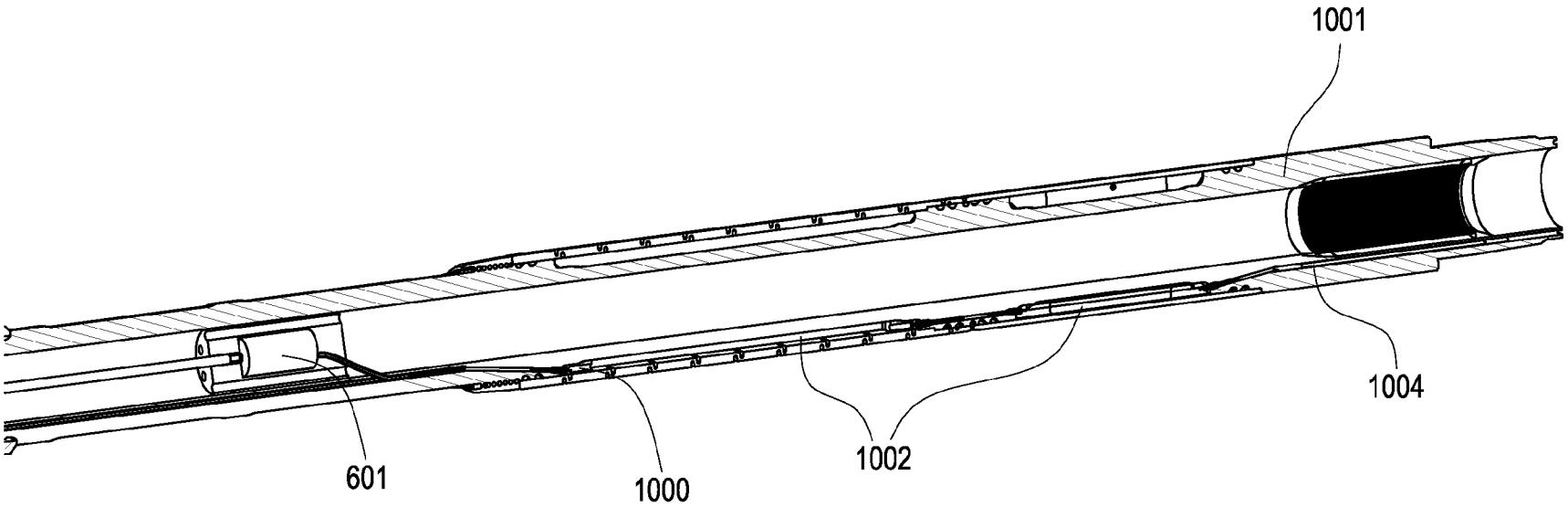
FIG. 10 is a cross-sectional diagram of an embodiment of a tool string.

The electric motor 601 may be in electrical communication with electronics 1000, as in the embodiment of FIG. 10. The electronics 1000 may be disposed within a recess or recesses formed in a bore wall 1001, the bore of the tool string, and/or in an outer diameter 1002 of the tool string component 211. The electronics 1000 in FIG. 10 may be in electrical communication with a downhole telemetry system 1004, such that the electric motor 601 may receive power from the surface, a downhole turbine or from another tool string component farther up the tool string 101. The electronics 1000 may also comprise sensors which measure downhole conditions or determine the position, rotational speed, or compression of the shaft of the jack assembly. The sensors may allow an operator on the surface to remotely monitor and/or control the drill bit 102. The electronics 1000 may comprise a closed loop system which uses information taken from the sensors and changes downhole drilling parameters such as rotational speed of the motor and/or orientation of the transmitter from a downhole assembly.

Figure 11:
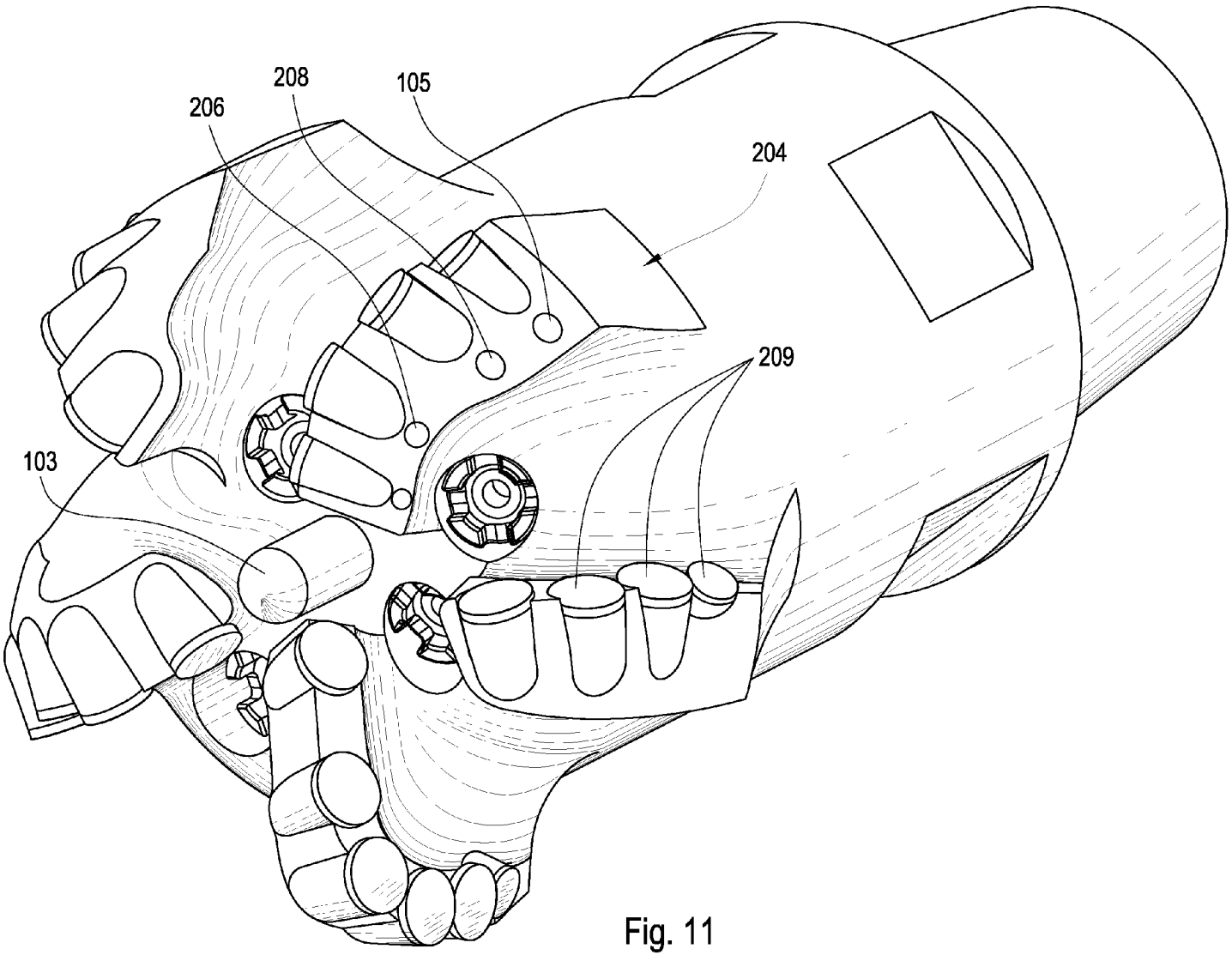
FIG. 11 is a perspective diagram of another embodiment of a drill bit.

FIG. 11 is a perspective diagram of another embodiment of a drill bit 102. In this embodiment the monitor electrode 206, the focusing electrode 208, and the receiver electrode 105 may be positioned on a single blade 204. The electrodes may be positioned behind the cutting elements 209.

Whereas the present invention has been described in particular relation to the drawings attached hereto, it should be understood that other and further modifications apart from those shown or suggested herein, may be made within the scope and spirit of the present invention.

What is claimed is:

1. A downhole drill bit, comprising;

a drill bit with a body intermediate a shank and a working surface;

an electric transmitter electrically isolated from the body and extending from the working surface;

a wear-resistant electric receiver electrically isolated from the bit body and being connected to a tool string component; and at least two wear-resistant electrically isolated electrodes located intermediate the electric transmitter and the wear-resistant receiver along the working surface and being adapted to measure a potential in the formation.

2. The downhole drill bit of claim 1, wherein the tool string component is the drill bit.

3. The downhole drill bit of claim 2, wherein the wear-resistant electric receiver is attached to a gauge of the drill bit.

4. The downhole drill bit of claim 1, wherein the tool string component is a stabilizer or a reamer.

5. The downhole drill bit of claim 1, wherein the drill bit is a shear bit or a percussion bit.

6. The downhole drill bit of claim 1, wherein the at least two wear-resistant electrically isolated electrodes comprise an electrically conductive polycrystalline diamond contact surface electrically isolated from the body.

7. The downhole drill bit of claim 1, wherein the receiver comprises an electrically conductive polycrystalline diamond contact surface electrically isolated from the body.

8. The downhole drill bit of claim 1, wherein the transmitter comprises a wear resistant electrically conductive coating.

9. The downhole drill bit of claim 1, wherein the electrodes are incorporated into penetration limiters or cutting elements.

10. The downhole drill bit of claim 1, wherein the receivers are incorporated into penetration limiters or cutting elements.

11. The downhole drill bit of claim 10, wherein the cutting elements are encased within a dielectric material.

12. The downhole drill bit of claim 1, wherein the working face further comprises a bucking electrode.

13. The downhole drill bit of claim 11, wherein the bucking electrode is incorporated into a penetration limiter, or a cutting element.

14. The downhole drill bit of claim 1, wherein the transmitter is in electrical communication with a battery, telemetry system, or a power generator.

15. The downhole drill bit of claim 1, wherein a distal end of the transmitter is comprised of an asymmetric geometry for steering the drill bit.

16. The downhole drill bit of claim 1, wherein the transmitter is encased within a dielectric material.

17. The downhole drill bit of claim 15, wherein the dielectric material comprises a ceramic, a rubber, a plastic, a metal, or a gas.

18. The downhole drill bit of claim 1, wherein the device further comprises a plurality of receivers disposed on different blades formed in the working face of the drill bit.

19. The downhole drill bit of claim 1, wherein the drill bit further comprises a plurality of electrodes disposed on different blades formed in the working face of the drill bit.

20. The downhole drill bit of claim 1, wherein the electrodes are incorporated onto a conical surface, a flat surface, a rounded surface, or a domed surface.

21. The downhole drill bit of claim 1, wherein the electrically isolated transmitter is incorporated into a cutter element or a penetration limiter.

22. The downhole drill bit of claim 1, wherein at least one of the transmitter, receiver, and electrodes is spring loaded.

* * * * *